US005697716A

United States Patent [19]

Akahane

[11] Patent Number: 5,697,716

[45] Date of Patent: Dec. 16, 1997

[54] PRINTER SHEET FEEDER

[75] Inventor: Takashi Akahane, Nagano, Japan

[73] Assignee: Seiko Epson Corporation, Tokyo-to, Japan

[21] Appl. No.: 659,786

[22] Filed: Jun. 6, 1996

[30] Foreign Application Priority Data

Jun. 9, 1995 [JP] Japan ..... P HEI 7-167927

[51] Int. Cl.[6] ..... B41J 11/58

[52] U.S. Cl. ..... 400/624; 400/629; 271/3.08; 271/4.08; 271/10.09; 271/109; 271/111; 271/121; 271/226

[58] Field of Search ..... 400/624, 625, 400/629; 101/232; 271/3.01, 3.08, 3.09, 4.08, 10.09, 109, 111, 117, 121, 123, 124, 125, 126, 226, 233, 245

[56] References Cited

U.S. PATENT DOCUMENTS

| | | | |
|---|---|---|---|
| 4,594,013 | 6/1986 | Costa et al. | 400/625 |
| 4,679,953 | 7/1987 | Sone et al. | 400/629 |
| 4,798,374 | 1/1989 | Ito | 400/629 |
| 5,035,413 | 7/1991 | Yamada et al. | 400/629 |
| 5,178,378 | 1/1993 | Nakajima | 400/629 |
| 5,211,690 | 5/1993 | Mizoguchi et al. | 400/629 |
| 5,480,247 | 1/1996 | Saikawa et al. | 271/126 |
| 5,531,531 | 7/1996 | Hirano | 271/121 |

FOREIGN PATENT DOCUMENTS

0627321 A1 12/1994 European Pat. Off. .

*Primary Examiner*—Eugene H. Eickholt
*Attorney, Agent, or Firm*—Stroock & Stroock & Lavan LLP

[57] ABSTRACT

A printer is provided with a hopper dimensioned to retain a plurality of sheets thereon and a sheet feed roller for feeding an uppermost sheet out of the plurality of sheets maintained on the hopper. Further, a separation pawl is located at a corner portion of the plurality of sheets held on the hopper for separating an uppermost sheet from a next sheet if the sheets to be printed upon are relatively thin. A wall surface is located downstream in a sheet feed direction with respect to the plurality of sheets maintained on the hopper is also provided for separating an uppermost sheet from a next sheet if the sheets to be printed upon are relatively thick. A selecting mechanism for selecting either a separating operation utilizing the separation pawl or a separating operation utilizing the wall surfaces also provided on the printer. A recess is formed by the hopper in a surface thereof for accommodating the separation pawl at a position lower than the plurality of sheets held on the hopper when the separating operation utilizing the wall surface is selected by the selecting mechanism. Finally, a regulating means for regulating the separation pawl when the separating operation utilizing the separation pawl is selected by the selecting mechanism is provided so that said separation pawl does retreat fully into the recess.

14 Claims, 12 Drawing Sheets

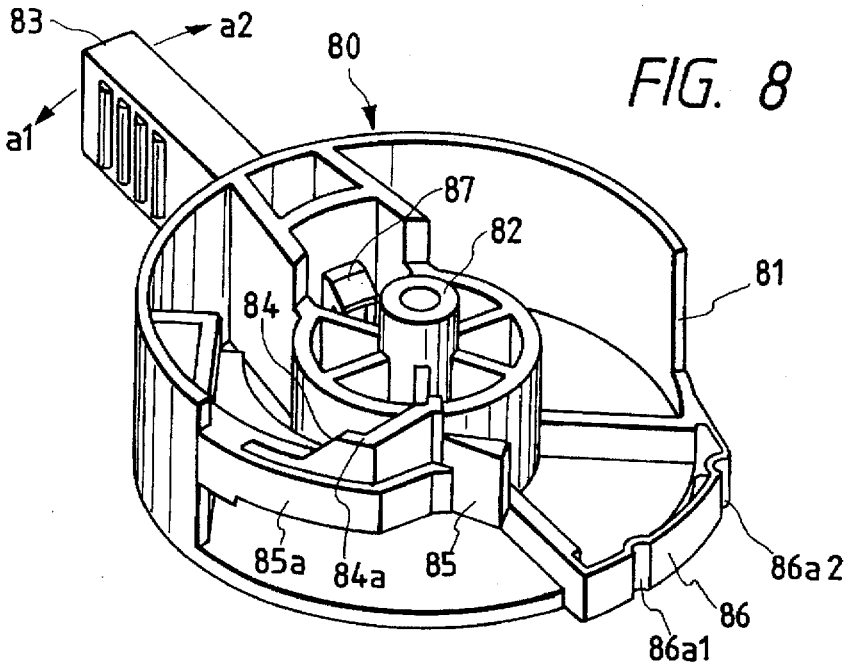
FIG. 8
FIG. 9(a)
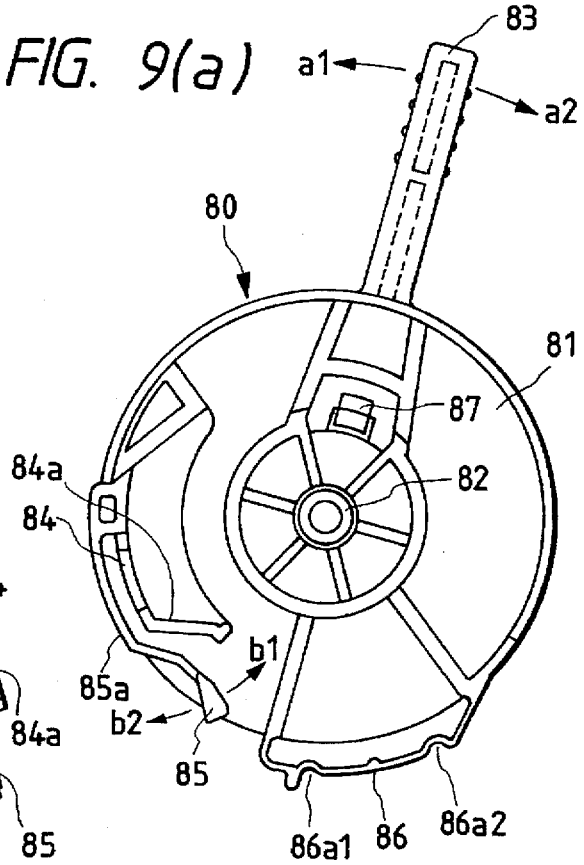
FIG. 9(b)
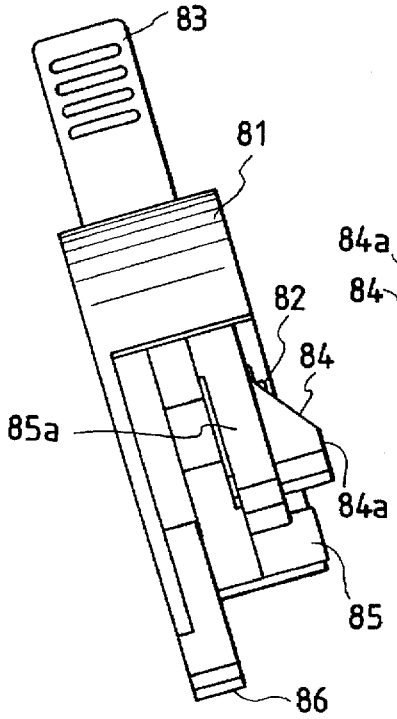

PRINTER SHEET FEEDER

BACKGROUND OF THE INVENTION

1. Field of the invention

This invention relates generally, to a printer, and more particularly to a printer with a sheet feeder, a hopper and a separation pawl.

2. Related art

A printer shown in FIGS. 13(*a*)–(*c*) is known in the art. This printer has a hopper 1, a sheet feed roller 2, a separation pawl 3, a wall surface 4, and a selecting mechanism (not shown). Hopper 1 accommodates a plurality of sheets P held thereon. Hopper 1 is designed to urge each of sheets P toward sheet feed roller 2 in the direction indicated by the arrow F in FIG. 13(*b*). In response to the elastic force exerted thereon by a biasing means comprising a hopper spring (not shown). Sheet feed roller 2 is driven to rotate in the direction indicated by arrow L in FIG. 13(*b*) while being in contact with an uppermost sheet P1 of the plurality of sheets P maintained on hopper 1, and therefore feeds uppermost sheet P1.

Separation pawl 3 is located at corner portions Pc of sheets P maintained on hopper 1 and exerts a small pressure on corner portions Pc of sheets P in the direction into the page in FIG. 13(*a*) and down from above in FIG. 13(*b*). Wall surface 4 is located downstream in the sheet feed direction from plurality of sheets P and is maintained in contact with a front end Pa of a sheet P each time a sheet P is fed.

The selecting mechanism (not shown) is designed to perform one of a number of selecting operations based upon the types of sheets held on hopper 1. The selecting operations include a first separating operation utilizing separation pawl 3 and a second separating operation utilizing wall surface 4. In a preferred embodiment, the selecting mechanism is operated by the user, but may be an automatic mechanism. If sheets P held on hopper 1 are relatively thin sheets, such as standard ordinary sheets, first separating operation utilizing separation pawl 3 is selected, whereas if sheets P held on hopper 1 are relatively thick sheets such as postcards or the like, second separating operation utilizing wall surface 4 is selected. The determination of which selected separating operation will be used is made before sheets P are piled up on hopper 1.

When first separating operation utilizing separation pawl 3 has been selected, separation pawl 3 exerts a small pressure on corner portions Pc of sheets P from above and in the direction indicated by the arrow M as shown in FIG. 13(*b*). When the feeding of an uppermost sheet P1 in the direction indicated by arrow A in FIG. 13(*a*) is started by the rotation of sheet feed roller 2, a portion of sheet P1 adjacent corner portion Pc is flexed upward, while corner portion Pc of sheet P1 has a pressure exerted thereon by separation pawl 3 and is therefore held against the plurality of sheets held on hopper 1. As sheet P1 is further moved in the direction indicated by arrow A, this flexed portion of sheet P1 becomes more pronounced. Thereafter, corner portion Pc of sheet P1 releases from under separation pawl 3 and the restoring force of sheet P1 causes sheet P1 to spring off hopper 1. As a result, uppermost sheet P1 is separated from a next sheet P2 and thus, only one uppermost sheet P1 is fed at a time.

When the second separating operation utilizing wall surface 4 is selected and relatively thick sheets PH are to be fed, separation pawl 3 is maintained in a recess 1*a* disposed at the front corner of hopper 1, by the operation of the selecting mechanism, as shown in FIG. 13(*c*). Separation pawl 3 is thus maintained at a level lower than a surface 1*b* on the hopper 1 upon which a plurality of sheets P are piled so that separation pawl 3 will not disturb any of the relatively thick sheets PH, such as postcards or the like, when these thick sheets are set on hopper 1.

When an uppermost sheet PH1 is fed in the direction indicated by arrow A in FIG. 13(*a*) by the rotation of sheet feed roller 2, a head end PHa of sheet PH1 comes in contact with wall surface 4 so that the sheet PH1 is flexed concavely. This flexed portion of sheet PH1 becomes more pronounced than a corresponding flexed portion of a head end of a next sheet PH2 that moves slightly when dragged by uppermost sheet PH1, the flexed portion of next sheet PH2 also being caused by head end PH*a* of sheet PH2 coming into contact with wall surface 4. As this flexed portion of PH1 becomes more pronounced, head end PH*a* of sheet PH1 is forced over the top of wall surface 4, sheet PH1 is separated from a plurality of sheets P. Therefore, uppermost sheet PH1 is separated from next sheet PH2, and it is insured that only uppermost sheet PH1 is fed.

That is, the thus constructed conventional printer of the prior art, by employing a selection operation utilizing separation pawl 3, allows relatively thin sheets to be fed one at a time so that printing may be performed on the relatively thin sheets, and allows relatively thick sheets to be fed one at a time by employing a selection operation utilizing wall surface 4 so that printing may be performed on the relatively thick sheets.

While such a prior art printer has been satisfactory, the following problems may occur when the separating operation utilizing separation pawl 3 is selected. Specifically, when utilizing the first separation operation and the number of sheets held on hopper 1 is decreased to a small number (e.g., two or three sheets), separation pawl 3 is substantially situated within recess 1*a* arranged at the front end corner of hopper 1 as is shown in FIG. 14 (*a*) and (*b*). Thus, the corner portion P1*c* of the uppermost sheet P1 and the corner portion P2*c* of the next sheet P2 are both flexed at the same time prior to the beginning of the sheet feed operation is started by sheet feed roller 2. As a result, during a sheet feed operation by sheet feed roller 2 corner portion P1*c* of uppermost sheet P1 and corner portion P2*c* of next sheet P2 are both released from under separation pawl 3 at the same time. As a result, an inadvertent "multi-sheet feed" may take place in which uppermost sheet P1 and next sheet P2 are both improperly fed at the same time.

Thus, it is desired to overcome the aforementioned problem and to provide a printer in which a multi-sheet feed is prevented from taking place when first separating operation utilizing the separation pawl is employed.

SUMMARY OF THE INVENTION

Generally speaking, in accordance with the invention, an improved sheet feed mechanism is provided and includes a hopper on which a plurality of sheets are held. A sheet feed roller feeds an uppermost sheet out of the plurality of sheets held on hopper while being maintained in contact with the uppermost sheet. A separation pawl is located at a corner portion of the sheets held on the hopper. If the sheets are relatively thin, the separation pawl is utilized for separating the uppermost sheet from a next sheet. A wall surface is located at a head end of the plurality of sheets held on the hopper. If the sheets are relatively thick, the wall surface is utilized for separating an uppermost sheet from a next sheet. A selecting mechanism coupled to the separating pawl to select whether the separation pawl or the wall surface will be utilized during the separating operation. A recess is formed in the hopper for accommodating the separation pawl at a position lower than a surface of the hopper upon which the sheets are held when the separating operation utilizing the wall surface is selected by the selecting mechanism.

Finally, a regulating member regulates the separation pawl. This regulating member operates when the separating operation utilizing the separation pawl is selected by the selecting mechanism so that the separation pawl is kept from reaching a position in which it is contained substantially within the recess, which is the position the separation pawl reaches when the separating operation utilizing the wall surface is selected by the selecting mechanism and the separation pawl is not being utilized.

Therefore, when the separating operation utilizing the separation pawl is selected by the selecting mechanism to separate one sheet from a plurality of relatively thin sheets, the uppermost sheet of the plurality of relatively thin sheets held on the hopper is separated from a next sheet by the separation pawl and is fed by the sheet feed roller. Further, when the separating operation utilizing the wall surface is selected by the selecting mechanism to separate one sheet from a plurality of relatively thick sheets, the separation pawl is accommodated in the recess arranged in the hopper, and the uppermost sheet of the plurality of relatively thick sheets held on the hopper is separated from a next sheet by the wall surface and is fed by the sheet feed roller.

When the separating operation utilizing the separation pawl is selected by the selecting mechanism, the separation pawl is regulated by the regulating member to insure that the separation pawl will not be maintained substantially within the recess, which is the position occupied by the separation pawl when the separating operation utilizing the wall surface is selected by the selecting mechanism and the separation pawl is not in use.

Therefore, even when the number of relatively thin sheets piled up on the hopper is reduced to a small number of two or three, the printer can prevent the corner portions of successive sheets from being flexed simultaneously before the sheet feed operation is started by the sheet feed roller. As a result, it is only when the sheet feed operation is started by the sheet feed roller that a large flex is provided in the first sheet so that this uppermost sheet may be separated from the plurality of sheets. Hence, the uppermost sheet may be separated from the next sheet, allowing only the uppermost sheet to be fed.

Accordingly, it is an object of the invention to provide an improved sheet feeding mechanism for a printer.

Another object of the invention is to provide an improved sheet feeding mechanism for a printer which insures proper feeding whether thin or thick sheets are utilized.

A further object of the invention is to provide a printer which can prevent an inadvertent multi-sheet feed when relatively thin sheets are utilized.

Still other objects and advantages of the invention will in part be obvious and will in part be apparent from the specifications and drawings.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

FIG. 4(*b*) is a cross-sectional view taken along line b—b of FIG. 4(*a*).

FIG. 8 is an enlarged perspective view of an operation lever constructed in accordance with the invention;

FIG. 9(*a*) is an enlarged side elevational view of the operation lever constructed in accordance with the invention;

FIG. 9(*b*) is an enlarged front elevational view of the operation lever of FIG. 9(*a*);

FIG. 10(*b*) is a side elevational view of the intermediate operating body constructed in accordance with the invention;

FIG. 10(*c*) is an opposite side elevational view of the intermediate operating body constructed in accordance with the invention;

FIG. 10(*d*) is a bottom plan view of the intermediate operating body constructed in accordance with the invention;

FIG. 10(*e*) is a rear elevational view of the intermediate operating body constructed in accordance with the invention;

FIG. 11(*b*) is a cross-sectional view taken along line b—b of FIG. 11(*a*);

FIG. 12(*b*) is a cross-sectional view taken along line b—b of FIG. 12(*a*);

FIG. 13(*b*) is a cross-sectional view taken along line b—b in FIG. 13(*a*);

FIG. 13(*c*) depicts a second operating mode of a conventional printer;

FIG. 14(*b*) is a cross-sectional view taken along line b—b of FIG. 14(*a*).

DETAILED DESCRIPTION OF THE PREFERRED EMBODIMENTS

Figure 1:
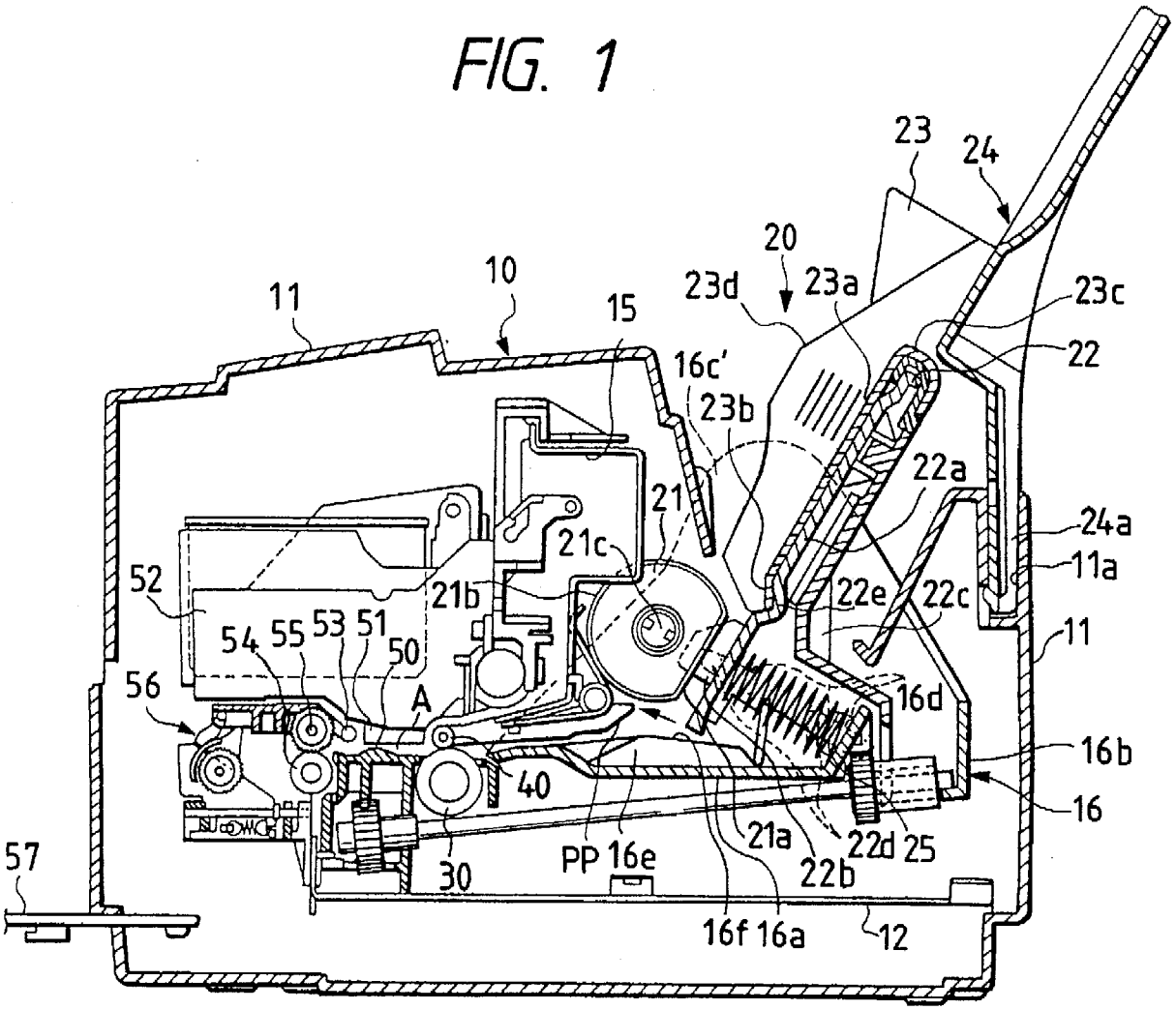
FIG. 1 is side cross-sectional view of an ink jet printer constructed in accordance with the invention.
Figure 6:
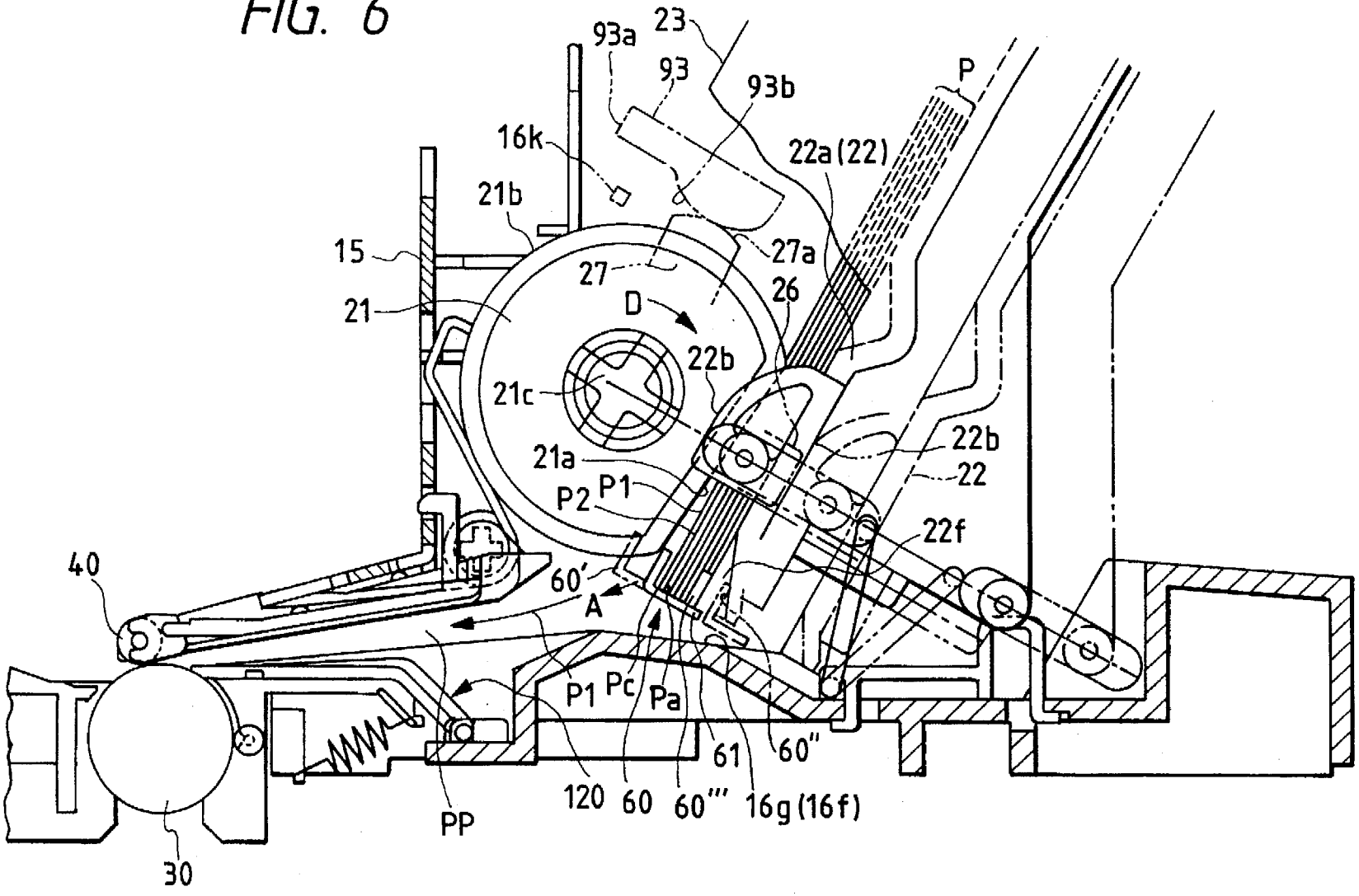
FIG. 6 is an enlarged side partial cross-sectional view of the printer constructed in accordance with the invention showing positioning of the separating pawl in phantom.

Reference is first made to FIG. 1, in which a printer main body 10 is formed with a case 11 and an automatic sheet feeder 20 incorporated within main body 10. Referring next to FIG. 6 in addition to FIG. 1, a sheet feed path PP, through which a sheet of paper P fed by automatic sheet feeder 20 passes, is shown. At least one sheet forward roller 30 is mounted within printer body 10 downstream of automatic sheet feeder 20 along sheet feed path PP. A pinch roller 40 is maintained in pressure contact with sheet forward roller 30 and is driven to rotate thereby. A regulating member 50 adapted to guide a non-print side of sheet P is disposed downstream of rollers 30, 40 along sheet feed path PP. A carriage 52 is supported within casing 11 and supports an ink jet head 51 and the like mounted thereon to perform a print operation by ejecting ink droplets onto a print side of sheet P. A guide roller 53 positioned downstream of ink jet head 51 guides sheet P along sheet feed path PP. A pair of sheet discharge rollers 54, 55 are disposed between guide roller 53 and a sheet discharge section 56. Further, fixed to a front of main body 10 a sheet discharge tray 57 is provided on which discharged sheets are stacked after they have been printed upon.

As shown in FIG. 6, sheet P1 is fed by automatic sheet feeder 20 and contacts sheet forward roller 30 along sheet feed path PP. Sheet feed path PP is concavely curved as viewed in FIGS. 1 and 6. Sheet P1 is further forwarded by sheet forward roller 30 with the angle of forwarding of sheet P1 being regulated by the positioning of pinch roller 40. Thus sheet P1 has its front end Pa and its back end Pb guided by regulating member 50 while essentially at all times being in contact with the upper surface of regulating member 50. Furthermore sheet P is guided to pinch roller 40 and sheet forward roller 30 by a sheet guide generally indicated as 120. Regulating member 50 also acts as a guide member so that the distance between the sheet P1 and ink jet head 51 is maintained at a constant, predetermined value. As a result, ink is properly ejected from head 51 onto a front surface of sheet P1. Sheet P1, after being printed upon, is then discharged onto a sheet discharge tray 57 via the pair of sheet feed rollers 54, 55 and a sheet discharge section 56.

Figure 2:
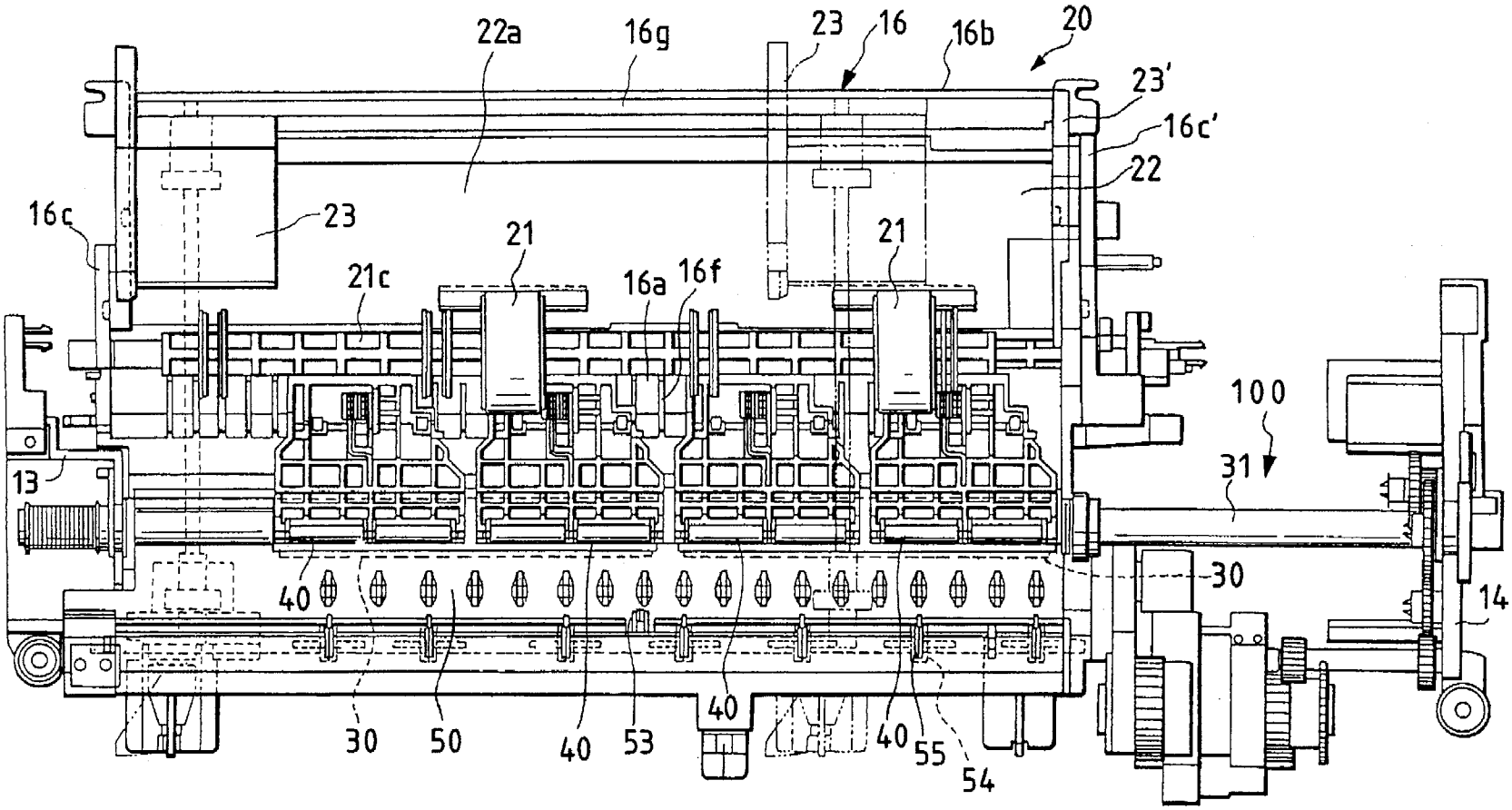
FIG. 2 is partial top plan view of the printer constructed in accordance with the invention.

Referring next to FIGS. 1 and 2, details of automatic sheet feeder 20, sheet forward roller 30, and pinch roller 40 will be described. Main body 10 is formed with a bottom frame 12, side frames 13, 14, an intermediate frame 15, and a subframe 16 within case 11. In a preferred embodiment, bottom frame 12 is formed of a metal plate and serves also as a shield plate inside casing 11. Right and left side frames 13, 14, which are formed of plastic, are positioned adjacent the left and right sides of the bottom frame 12 and extend orthogonally thereto. Intermediate frame 15 bridges between side frames 13, 14 and is formed of a metal plate. Subframe 16 is formed of plastic, is secured to frames 13, 14 and is dimensioned to allow many of the internal components of the printer to be affixed thereto.

Figure 3:
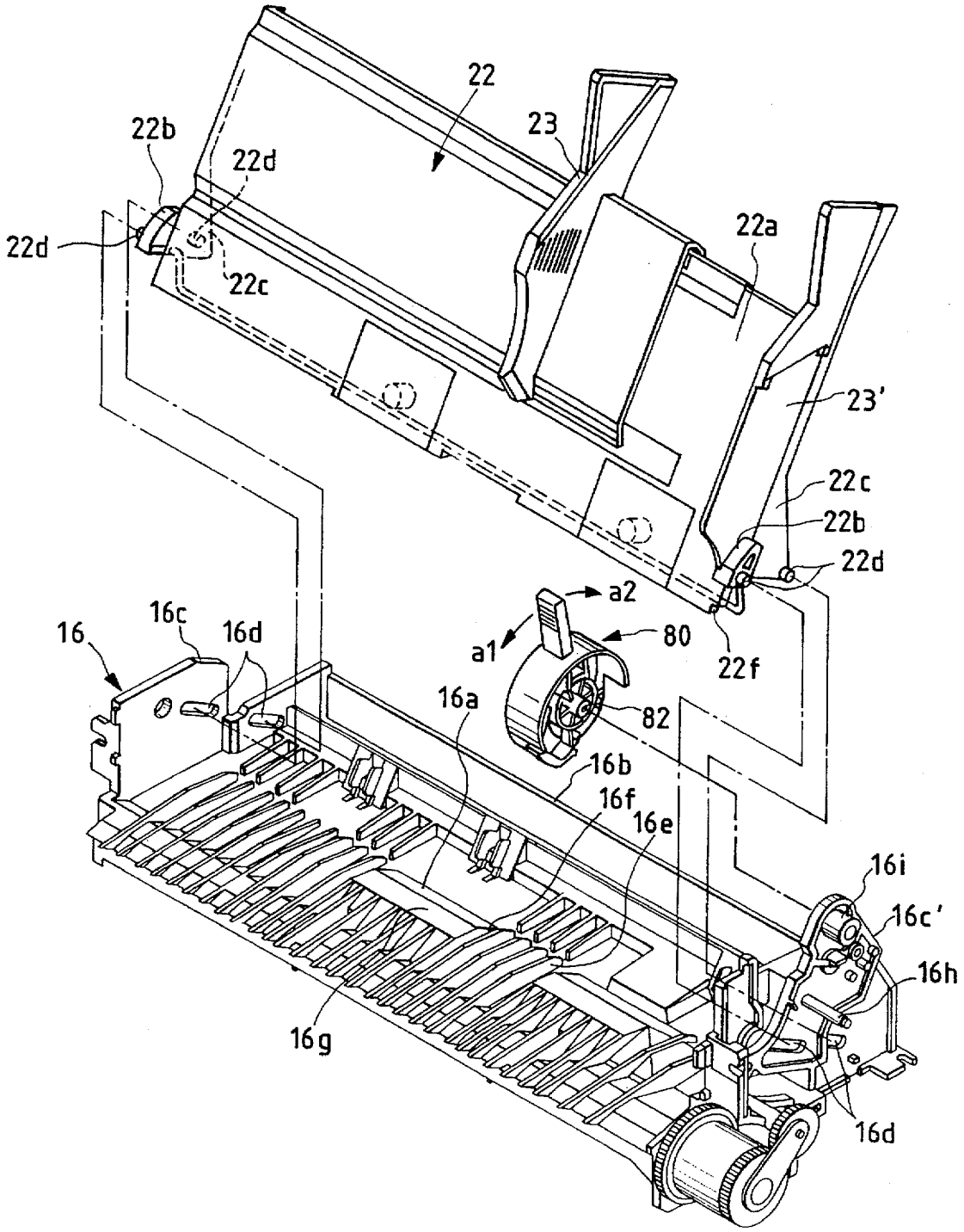
FIG. 3 is an exploded perspective view showing a subframe and a hopper constructed in accordance with the invention.

As is further shown in FIG. 3, subframe 16 further includes a bottom plate **16*a*, a back plate 16*b*, and side plates 16*c*, 16*c'*. Bottom plate 16*a* forms a lower portion of sheet path PP. Back plate 16*b* is formed integrally with bottom plate 16*a* at a back edge thereof. Side plates 16*c*, 16*c'* are also formed integrally with bottom plate 16*a* and with back plate 16*b* at each end thereof. Thus, bottom plate 16*a*, back plate 16*b*, and side plates 16*c*, 16*c'* are all formed integrally with each other. A rib-like sheet guide 16*e* is formed on a top surface of bottom plate 16*a*. An upper sloped surface 16*f* formed by rib-like sheet guide 16*e* is designed as a wall surface dimensioned to be employed in a sheet separation operation for separating relatively thick sheets from each other (see FIG. 7). Upper sloped surface 16*f*** will be further described below.

Side plate **16*c'* is formed with a shaft 16*i* and a shaft 16*h* extending therefrom away from bottom plate 16*a*. Guide holes 16*d* are formed in said plate 16*c'***.

Automatic sheet feeder 20 is also formed with a hopper 22, edge guides 23, 23' affixed on either side of hopper 22, a sheet feed tray 24 mounted to casing 11, and a separation pawl retracting mechanism 26 (see FIGS. 4 and 5) and a selecting mechanism 70. A grooved sheet feed roller shaft **21*c* is rotatably supported by side plates 16*c*, 16*c'* of subframe 16. A plurality of sheet feed rollers 21 are fixedly mounted on sheet feed roller shaft 21*d*. Each sheet feed roller 21 is formed with a D-shaped cross-section that includes a straight face 21*a* and an arcuate face 21*b* and is further formed with a rubber-coated surface. Sheet feed roller shaft 21*c* is driven to rotate by a transmission mechanism 110 that interlocks with a drive mechanism 100 during sheet feed operation. An auxiliary roller 21*d* is further shown in FIG. 4**.

As shown in FIG. 3, hopper 22 is formed with a bottom plate **22*a* for supporting the bottom surface of a sheet P. Hopper 22 includes cam followers 22*b*, 22*b* are formed integrally with bottom plate 22*a* so as to extend upward on opposed (both left and right) sides of bottom plate 22*a*. Triangular side plates 22*c*, 22*c* are also formed integrally with bottom plate 22*a* so as to extend away from bottom plate 22*a* on both left and right sides of bottom plate 22*a*. Pins 22*d* project sideways and are formed integral with cam followers 22*b* and side plates 22*c*. Pins 22*d* engage pair of elongated holes 16*d*, 16*d* formed in side plates 16*c*, 16*c'* of subframe 16, to allow hopper 22 to be mounted so as to be slideably movable towards feed rollers 21 in a direction indicated by arrow H in FIG. 1 with respect to subframe 16. Recess 22*f* is formed at a front end corner of bottom plate 22*a*. A hopper spring 25 is situated between hopper 22 and bottom plate 16*a* of subframe 16. Hopper spring 25 biases hopper 22 obliquely in the direction indicated by arrow H in FIG. 1**.

Figures 4A, 4B:
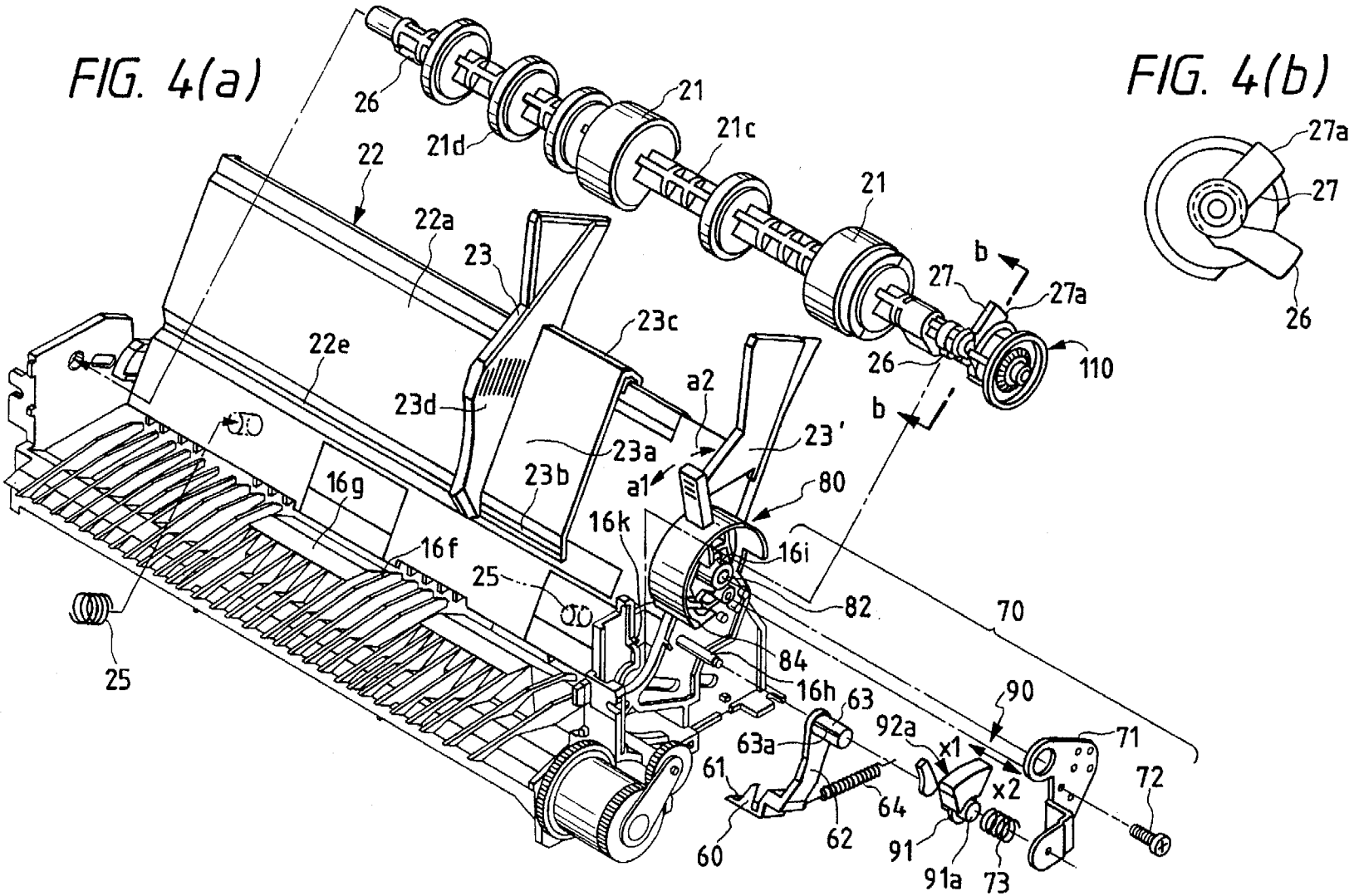
FIG. 4(*a*) is an exploded perspective view showing a selecting mechanism constructed in accordance with the invention.

A hopper spring 25 is positioned at locations corresponding to the location of each of the sheet feed rollers 21 shown in FIG. 4. As is further shown in FIG. 4, first cams 26, 26 are formed integral with sheet feed roller shaft **21*c*, each of cams 26 being positioned adjacent opposite ends thereof. Cams 26 are designed to hold hopper 22 against the elastic forces of hopper springs 25 while engaging cam followers 22*b* formed on edge guide 23' and bottom plate 22*a*. Hopper 22 is designed to release sheet P when straight face 21*a* of sheet feed roller 21 opposes it. That is, during a sheet feed operation, the holding force generated by cams 26 on hopper 22 is released, hopper 22 is urged in the direction indicated by arrow H in FIG. 1 and sheet P is pushed up by the pressure of hopper springs 25 so as to be biased onto sheet feed rollers 21. When a sheet feed operation is completed the holding force of cams 26 is restored by rotation of shaft 21*c* and hopper 22 is pressed in the direction opposite to that of arrow H in FIG. 1 by the cam mechanism so that sheet P is no longer maintained in contact with sheet feed rollers 21**.

Edge guide 23 is further formed with a bottom plate **23*a*, a bent portion 23*b* arranged on the front end portion of bottom plate 23*a*, a clip portion 23*c* arranged on the rear end portion of bottom plate 23*a*, and a side plate 23*d* extending substantially orthogonally from bottom plate 23*a*. Edge guide 23 is slidably mounted so as to be slidable with respect to hopper bottom plate 22*a*. Bent portion 23*b* is engaged with a groove 22*e* of hopper 22. Clip portion 23*c* resiliently clamps the rear portion (the upper end portion as shown in FIG. 1) of hopper 22 so as to enclose this rear portion. Edge guide 23** serves to guide the left side of a sheet P (not shown)

set on hopper 22 in FIG. 2. The right side of sheet P is guided by an inner side surface of a second edge guide 23' formed integral with bottom plate 22*a* of hopper 22.

As shown in FIG. 1, sheet feed tray 24 is releasably mounted on main body 10 by inserting an insertion piece 24*a* formed on the lower portion of sheet feed tray 24 into an insertion hole 11*a* formed in case 11 of main body 10 so that sheet feed tray 24 is detachably mounted on printer body 10. Sheet feed tray 24 is designed to support the bottom surface of sheet P in cooperation with hopper 22 when mounted on the main body 10.

Figure 5:
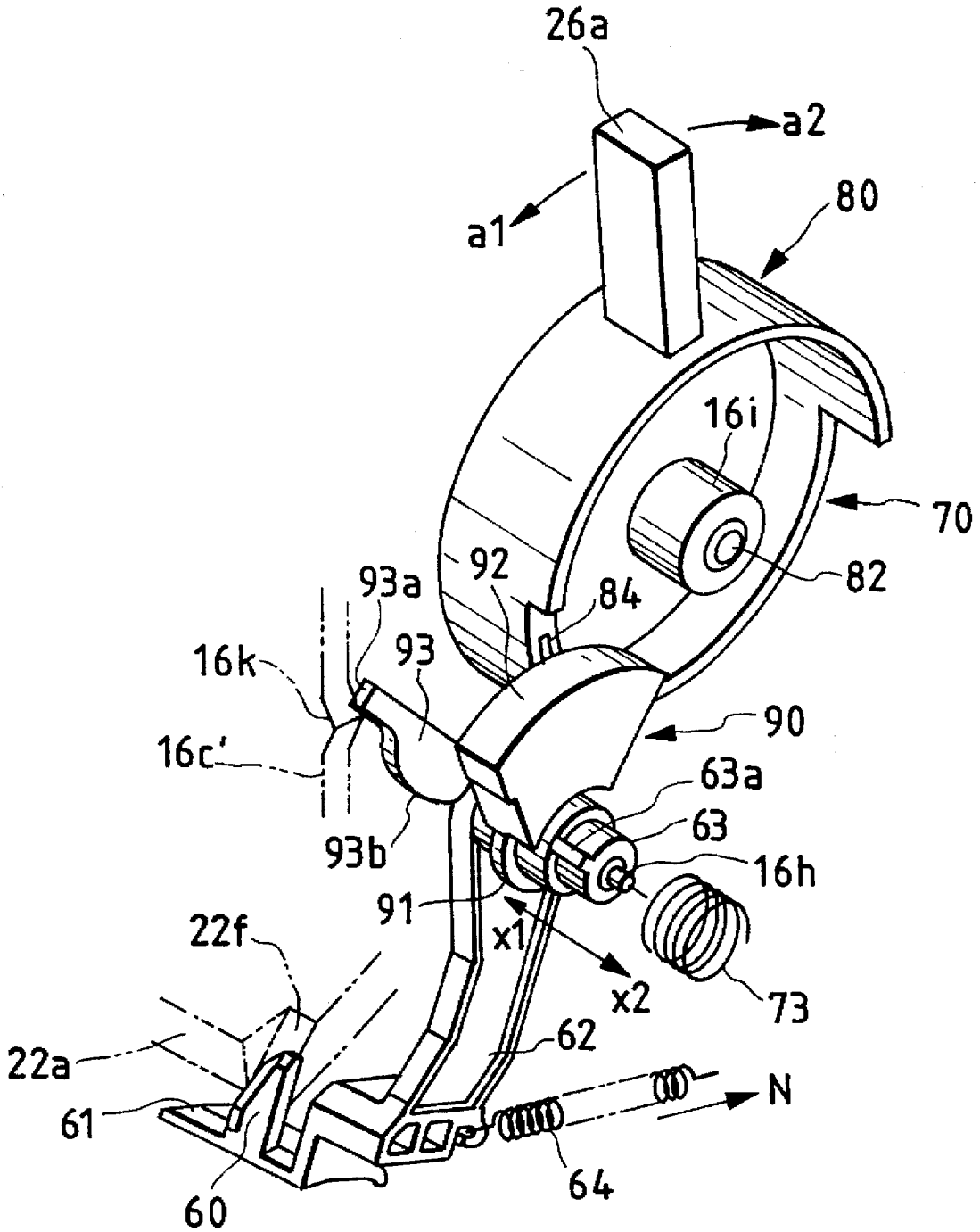
FIG. 5 is an enlarged perspective view showing a portion of the selecting mechanism constructed in accordance with the invention.

As shown in FIGS. 4–6, a separation pawl 60 is formed with a support plate 61, which supports the head end (lead end) Pa of sheet P set on hopper 22, as shown in FIG. 6. A cylindrical shaft 63 is connected to support plate 61 via an arm portion 62. Cylindrical shaft 63 is coaxially fitted over shaft 16*h* projecting from side plate 16*c* of subframe 16 so as to be rotatable with respect to side plate 16*c'* of subframe 16. A tension spring 64 is connected between arm portion 62 and side plate 16*c'* of subframe 16. Separation pawl 60 is urged towards bottom plate 22*a* in the direction of arrow N in FIG. 5 at all times by the biasing force of spring 64.

A selecting mechanism 70 is rotatably fixed to side plate 16*c'* of subframe 16 as shown in FIG. 4. Selecting mechanism 70 determines which of two sheet separating operations will be performed in accordance with the type of sheets to be held on hopper 22 and to be printed upon. These sheet separating operations either utilize separation pawl 60 to feed thin sheets or utilize wall surfaces 16*f*, 16*g* to feed thicker sheets.

Figure 7:
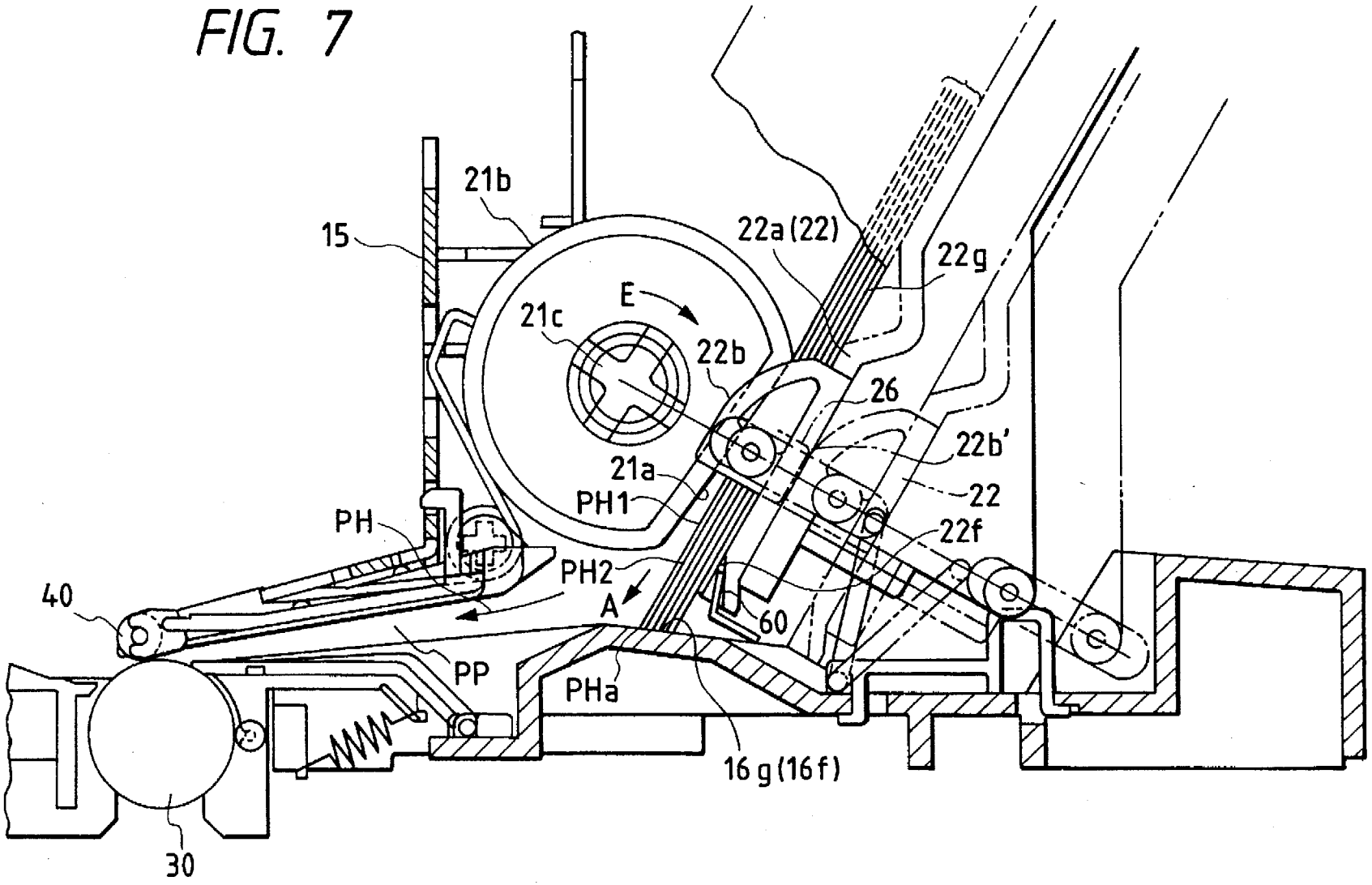
FIG. 7 is an enlarged side partial cross-sectional view of the printer constructed in accordance with the invention.
Figure 10E:
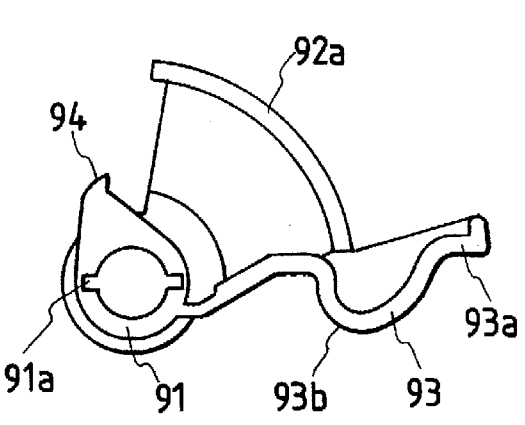
FIG. 10(*a*) is a front elevational view of an intermediate operating body constructed in accordance with the invention.
Figure 10C:
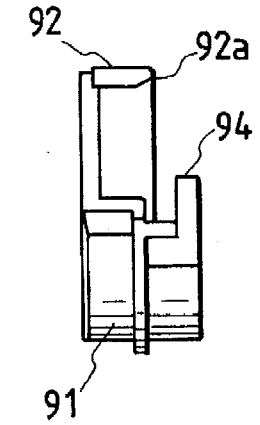
Figure 10A:
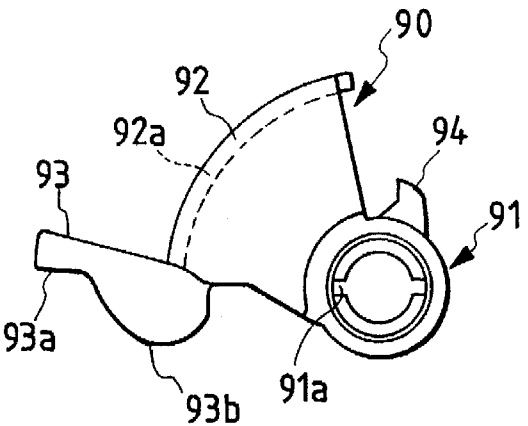
Figure 10B:
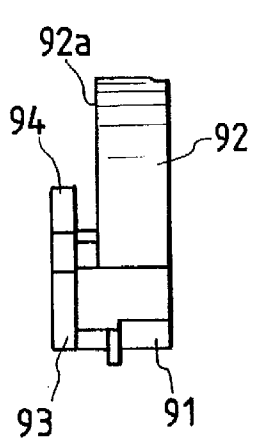
Figure 10D:
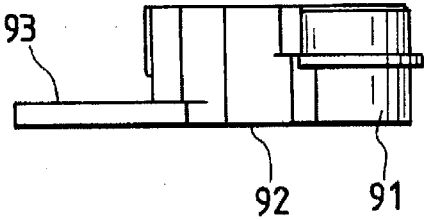

When the separating operation utilizing separation pawl 60 is selected, separation pawl 60 projects upward from bottom plate 22*a* of hopper 22, as is shown by the solid line in FIG. 6, so that separation pawl 60 can exert a small pressure on corner portions Pc of sheets P from above. When the separating operation utilizing wall surfaces 16*f*, 16*g* is selected, separation pawl 60 is maintained within recess 22*f* disposed in bottom plate 22*a* of hopper 22, as shown in FIG. 7.

A selecting mechanism 70 includes an operation lever 80, an intermediate operating body 90 and a cover 71. Reference is next made to FIGS. 8, 9(*a*) and 9(*b*), which depict operation lever 80. Operation lever 80 is integrally formed of a synthetic resin and is formed with a substantially drumlike base portion 81, a shaft receiving portion 82 positioned coaxially with respect to base portion 81 at a center portion thereof, a handle 83 fixed to the outer edge of base portion 81, a sloped cam 84 and a set piece 85, each situated within base portion 81, and a click plate 86 fixed to the outer edge of base portion 81 opposite the location of handle 83.

Operation lever 80 is mounted on the printer as to be rotatable with respect to side plate 16*c'* in two directions as indicated by arrows a1, a2 in FIGS. 8 and 9(*a*). Shaft portion 82 is inserted into a cylindrical bearing portion 16*i* arranged on the outside of side plate 16*c'* of subframe 16 as shown in FIGS. 3 and 4. A locking clip 87 insures that operation lever 80 is not inadvertently separated from subframe 16.

Click plate 86 is formed into a resilient thin plate member and further is formed with recesses 86*a*1, 86*a*2. When the operation lever 80 is operated to rotate in the direction indicated by arrow a1 in FIG. 11, recess 86*a*1 clicks to engage with a projection 16*j* (FIG. 12(*a*) ) projecting toward the inside of side plate 16*c'* to lock operation lever 80 in its position. When operation lever 80 is operated to rotate in the direction indicated by arrow a2 in FIGS. 8 and 9(*a*), recess 86*a*2 clicks to engage with projection 16*j* to lock operation lever 80 in its position. Set piece 85 is connected to base portion 81 through a plate spring portion 85*a* and is moveable in the directions indicated by arrows b1, b2 in FIG. 9(*a*). Set piece 85 is able to move because of the flexibility of plate spring portion 85*a*. The operation of sloped cam 84 and set piece 85 will be described below.

FIGS. 10(*a*)–(*e*) show intermediate operating body 90. Intermediate operating body 90 is integrally formed of synthetic resin or the like and includes a cylindrical base portion 91 which is dimensioned to coaxially fit over cylindrical shaft 63 of separation pawl 60, as shown in FIGS. 4 and 5. Intermediate operating body 90 is further formed with a fanlike cam follower portion 92 forming an outer edge of intermediate operating body 90, an arm portion 93 extending from fanlike cam follower portion 92, and a pawl portion 94 fixed to base portion 91. As shown in FIGS. 4 and 5, ridgelike projections 63*a* are formed on cylindrical shaft 63, and recessed grooves 91*a* are formed in the inner surface of the cylindrical base portion 91, recessed grooves 91*a* being selectively engageable with ridgelike projections 63*a*. Therefore, intermediate operating body 90 is coaxially fitted over cylindrical shaft 63 of separation pawl 60 so as to be unrotatable with respect thereto after fitting. An arcuate surface 92*a* of cam follower portion 92 is dimensioned to engage sloped cam 84 of operation lever 80.

Figure 12A:
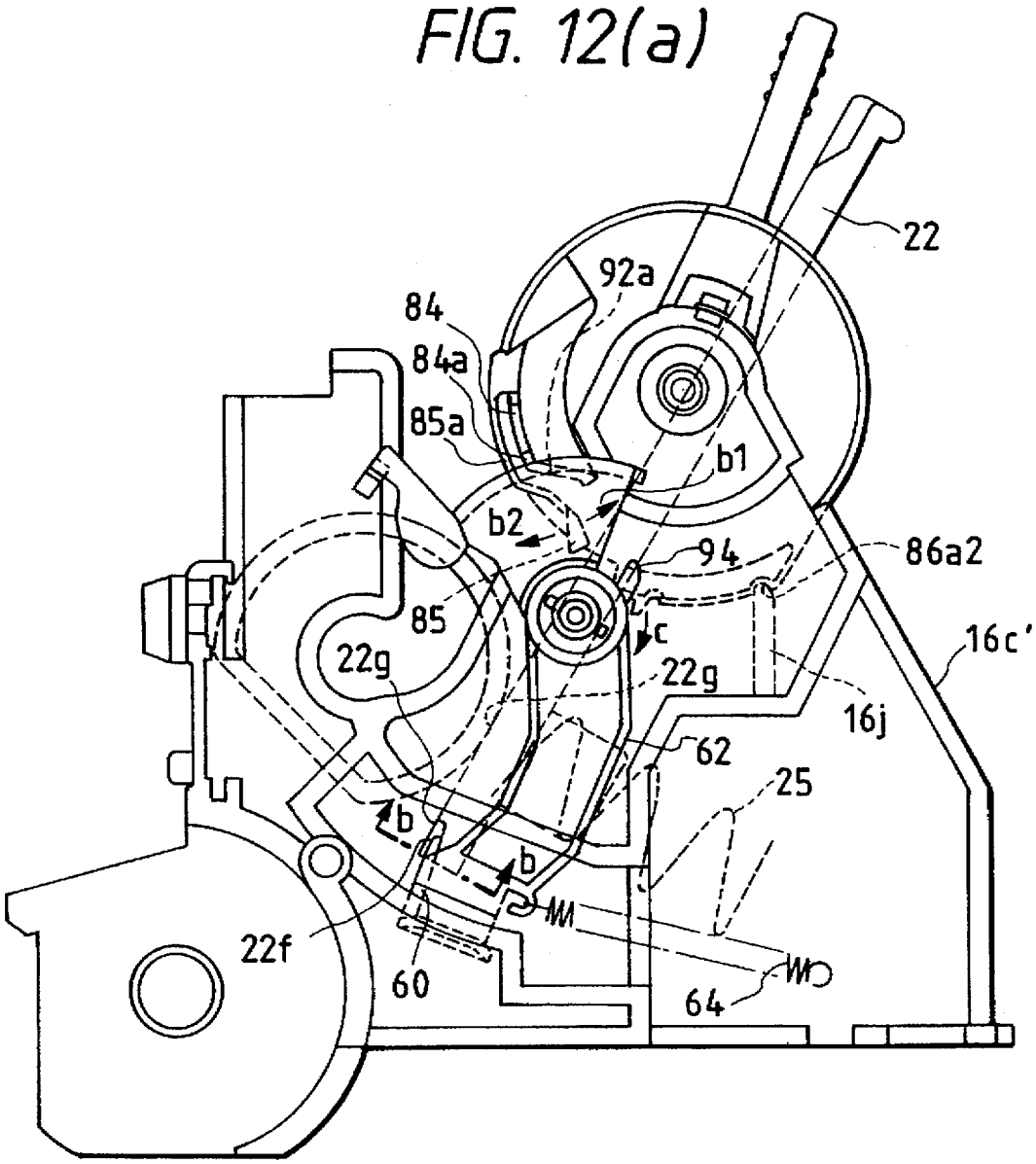
FIG. 12(*a*) is an enlarged side elevational view of the printer constructed in accordance with the invention illustrating the performance of an operation.
Figure 12B:
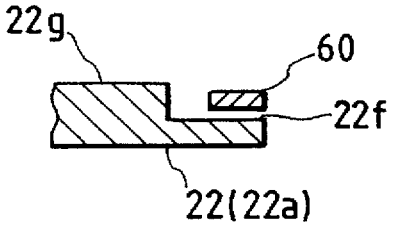
Figure 13A:
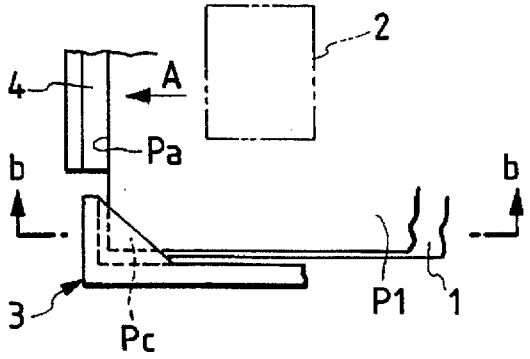
FIG. 13(a) PRIOR ART
FIG. 13(*a*) depicts a conventional printer.
Figure 13B:
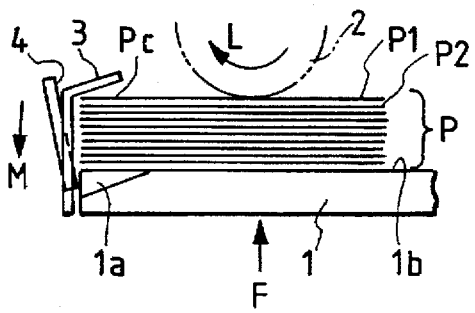
FIG. 13(b) PRIOR ART
Figure 13C:
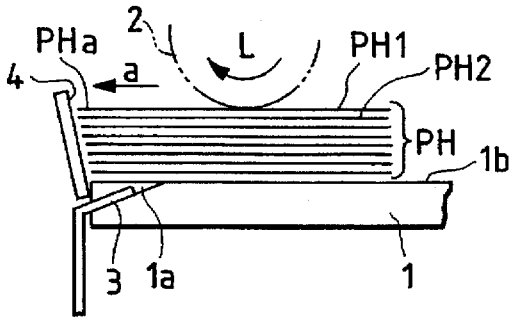
FIG. 13(c) PRIOR ART
Figure 14A:
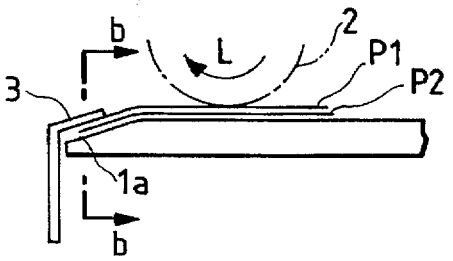
FIG. 14(a) PRIOR ART
FIG. 14(*a*) depicts a separation pawl operating in accordance with a conventional printer.
Figure 14B:
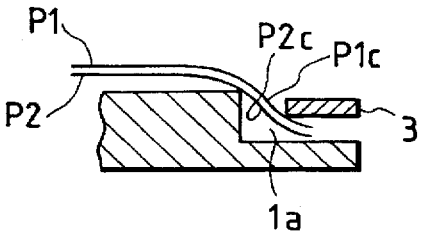
FIG. 14(b) PRIOR ART

Front end 93*a* of arm portion 93 is engageable with a projecting stopper 16*k* formed on the outside of side plate 16*c'* of subframe 16, as shown in FIGS. 4 and 5. Stopper 16*k* and arm portion 93 together constitute a regulator. Further, arm portion 93 serves also as a cam follower. As shown in FIGS. 4(*a*) and 4(*b*), sheet feed roller shaft 21*c* has a platelike second cam 27 formed integrally therewith. A substantially arcuate outer circumferential surface 93*b* of arm portion 93 is dimensioned to come in contact with cam surface 27*a* of the sheet feed roller shaft 21*c* (see FIG. 6). Pawl portion 94 is engageable with set piece 85 of operation lever 80 as shown in FIG. 12(*a*).

Referring next to FIG. 4(*a*), a cover 71 is formed of sheet metal and is attached to side plate 16*c'* of the subframe 16 with a screw 72. A compression spring 73 is situated between cover 71 and intermediate operating body 90, by which intermediate operating body 90 is biased at all times in a direction indicated by an arrow X1 in FIGS. 4 and 5.

The thus constructed automatic sheet feeder 20 operates as follows.

Figure 11A:
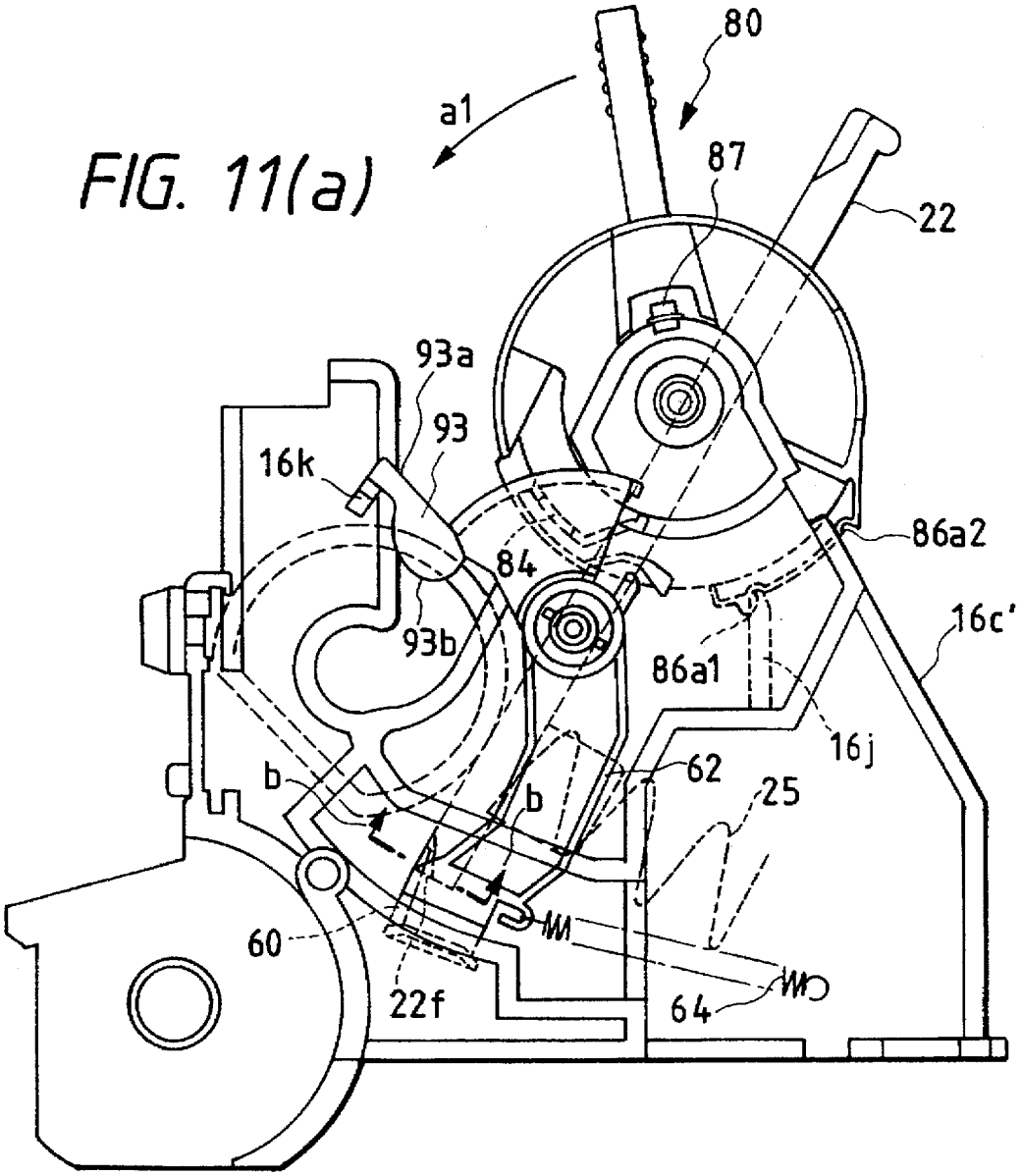
FIG. 11(*a*) is an enlarged side elevational view of the printer constricted in accordance with the invention illustrating the performance of an operation.
Figure 11B:
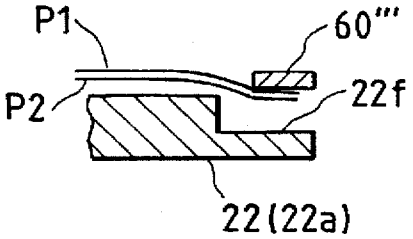

(i) when the sheets held on hopper 22 are relatively thin sheets such as ordinary sheets, operation lever 80 is rotated by the user in the direction indicated by arrow a1 as shown in FIG. 3, so that the separating operation utilizing separation pawl 60 is selected. When operation lever 80 has been rotated in the direction indicated by arrow a1 in FIG. 3, sloped cam 84 of operation lever 80 is released from contact with arcuate surface 92*a* of cam follower portion 92 of intermediate operating body 90, as is shown in FIGS. 4(*a*) and 11(*a*). As a result, intermediate operating body 90 moves out of the way and allows front end 93*a* of arm portion 93 to be able to engage with stopper 16*k*. However, front end 93*a* of arm portion 93 does not yet engage with stopper 16*k* as is shown in FIG. 11. That is, stopper 16K is positioned along a locus of points forming an arc formed by the turning of arm portion 93.

After this positioning, the following sheet feed operation is performed.

(a) When the printer of the invention is in a standby condition, sheet feed rollers 21 are not in operation as shown in FIG. 6. Straight faces 21*a* of the sheet feed rollers 21 confront sheets P held on hopper 22.

As shown by a phantom line in FIG. 6, first cam 26 on sheet feed roller shaft 21*c* comes in contact with cam follower 22*b* of hopper 22 so as to maintain the position of hopper 22 against the biasing force of hopper spring 25 (see FIG. 1). Second cam 27 comes in contact with outer circumferential surface 93*b* of arm portion 93 of intermediate operating body 90, which then causes intermediate operation body 90 and separation pawl 60 to turn counterclockwise against the biasing force of tension spring 64 (FIG. 5), so that separation pawl 60 is positioned above straight face 21*a* of sheet feed roller 21 as shown by a phantom line 60' in FIG. 6. Therefore, a plurality of sheets P can be easily placed on hopper 22 by loading such sheets P from above.

(b) Upon output of a sheet feed command signal from a control section (not shown) of the printer, sheet feed rollers 21 start rotating in the direction indicated by arrow D in FIG. 6. As a result, first cam 26 and second cam 27 also rotate in the same direction. As first cam 26 starts rotating, hopper 22 is released from contact with respect to cam follower 22*b*, and, therefore, as shown by a solid line in FIG. 6, hopper 22 urges sheets P toward sheet feed rollers 21 by the biasing force of hopper spring 25 as is shown in FIGS. 1 and 6. Further, when second cam 27 starts rotating, intermediate operating body 90 is released from contact with outer circumferential surface 93*b* of arm portion 93, so that intermediate operating body 90 and separation pawl 60 rotates counterclockwise under the biasing force of tension spring 64 (FIG. 5). As a result, separation pawl 60 exerts a small pressure on corner portions Pc of sheets P by the biasing force of the tension spring 64 as shown by a solid line in FIG. 6.

When uppermost sheet P1 comes in contact with arcuate face 21*b*, sheet P1 is fed in the direction indicated by arrow A in FIG. 6 while sheet feed rollers 21 are rotating. Front edge Pa of sheet P1 adjacent separation pawl 60 flexes and rises while corner portion Pc of sheet P1 is maintained under separation pawl 60 by the force exerted thereon. When the rising level of sheet P1 has reached a predetermined limit as sheet P1 is further fed in the direction indicated by the arrow A, corner portion Pc is released from under separation pawl 60 and the restoring force of sheet P1 causes sheet P1 to spring off hopper 22. As a result, uppermost sheet P1 is separated from a next sheet P2, thereby insuring that only uppermost sheet P1 is fed toward sheet forward roller 30. Fed sheet P1, thereafter undergoes a print operation and data is printed thereon by head 51 as described above. Sheet P1 is thereafter discharged from the printer.

When sheet feed rollers 21 make a full rotation, the printer returns to the condition in section (a) noted above. The full rotation of sheet feed rollers 21 is driven by a single-rotation clutch incorporated in a transmission mechanism 110 (see FIG. 4) and is in turn driven by drive mechanism 100.

(c) As the sheets are sequentially fed, the number of sheets on hopper 22 is decreased, separation pawl 60 gradually moves toward hopper 22 during the sheet feed operation. When there are only a small number (i.e. two or three) of remaining sheets P, separation pawl 60 tends to enter into recess 22*f* of hopper 22 as shown in FIG. 12. However, as shown FIGS. 5 and 11, front end 93*a* of arm portion of intermediate operating body 90 comes into contact with the stopper 16*k*. As a result, the rotation of intermediate operating body 90 in the counterclockwise direction, and thus, the rotation of separation pawl 60 in the counterclockwise direction is stopped, and as indicated by a phantom line 60'" in FIG. 6 and in FIG. 11(*b*). Thus, separation pawl 60 stops before reaching a position within recess 22*f* (see FIG. 12) as would be its position if the other separating operation utilizing wall surfaces 16*g*, 16*f* were chosen, (see FIGS. 11(*b*) and 12(*b*) ).

Therefore, even if the number of relatively thin sheets P held on hopper 22 is reduced to only two or three, the problem of corner portions Pc of sheets P from being largely flexed prior to the sheet feed operation being started by sheet feed rollers 21 is prevented (see FIG. 11(*b*)). Thus, it is only after the sheet feed operation is started by sheet feed rollers 21 that a large flexing of sheet P1, which is necessary for the separation of the sheets, is initiated. As a result, uppermost sheet P1 is separated from next sheet P2, allowing the uppermost sheet to be fed independently. That is, according to the invention, defective, multi-sheet feeding operations can be prevented when the separating operation utilizing separation pawl 60 is selected.

(ii) When the sheets held on hopper 22 are relatively thick sheets, such as postcards or the like, operation lever 80 is rotated in the direction indicated by arrow a2 as shown in FIG. 3, so that the separating operation utilizing wall surfaces 16*g*, 16*f* is selected.

When operation lever 80 has been rotated in the direction indicated by arrow a2, sloped cam 84 of operation lever 80 comes into contact with arcuate surface 92*a* of cam follower portion 92 of intermediate operating body 90, so that intermediate operating body 90 is moved in the direction indicated by arrow X2 in FIG. 5 against biasing force of compression spring 73. As a result, front end 93*a* of arm portion 93 moves sideways to a position so as to not engage with stopper 16*k*, and outer circumferential surface 93*b* of arm portion 93 moves sideways out of contact with second cam 27. Therefore, separation pawl 60 rotates counterclockwise by the operation of tension spring 64 to be maintained in recess 22*f* of hopper 22 as shown in FIG. 12 and as indicated by a phantom line 60" in FIG. 6. Separation pawl 60 is placed at a position below sheet holding surface 22*g* of hopper 22 so that separation pawl 60 does not disturb relatively thick sheets PH such as postcards or the like when such sheets are set in hopper 22 as shown in FIG. 7.

FIG. 12 shows operation lever 80 after having been fully rotated in the direction indicated by arrow a2 in FIG. 4. Arcuate surface 92*a* of cam follower portion 92 of intermediate operating body 90 comes into contact with flat surface portion 84*a* which is continuous with sloped cam 84 of operating lever 80, so that the movement of intermediate operating body 90 in the direction indicated by arrow X1 in FIG. 5 is blocked.

After this positioning, the following sheet feed operating is performed.

(a) When the printer is in standby condition, sheet feed rollers 21 are not in operation as shown in FIG. 7. Therefore, straight faces 21*a* of sheet feed rollers 21 confront relatively thick sheets PH held on hopper 22. First cam 26 on sheet feed roller 21*c* comes into contact with cam follower 22*b*' of hopper 22 as shown by a phantom line in FIG. 7, so that hopper 22 is maintained against the biasing force of hopper spring 25. Thus, a plurality of sheets can be easily set in hopper 22 by putting the plurality of sheets PH into hopper 22 from above.

(b) Upon input of a sheet feed command signal from the control section (not shown) of the printer, sheet feed roller 21 starts rotating in the direction indicated by an arrow E in FIG. 7. As a result, first cam 26 also starts rotating and thereby releases hopper 22 from contact with cam follower 22*b*. Hence, hopper 22 urges sheets PH toward sheet feed roller 21 by the biasing force of hopper spring 25 as is shown by a solid line in FIG. 7.

Since sheet feed roller 21 is rotating, an uppermost sheet PH1 comes into contact with arcuate face 21*b* thereof, and sheet PH1 is fed in the direction indicated by an arrow A in FIG. 7. As a result, head and PH*a* of sheet PH1 flexes concavely while coming in contact with wall surfaces 16*g*, 16*f*. This flex grows larger than a flex of the head end of a next sheet PH2 in hopper 22. Sheet PH2 moves and flexes slightly because it is dragged by uppermost sheet PH1 when sheet PH1 it is fed. The flexing of next sheet PH2 also results from the head end of next sheet PH2 coming in contact with the wall surfaces 16*g*, 16*g*. Therefore, uppermost sheet PH1 is separated from next sheet PH2, and only uppermost sheet PH1 is fed toward sheet forward roller 30. Fed sheet PH1 thereafter undergoes a print operation in which data is printed thereon by head 51 as described above sheet PH1 and is thereafter discharged from the printer.

(iii) When operation lever 80 is rotated in the direction indicated by arrow a1 in FIG. 5 from its position shown in FIG. 12, in order to perform a print operation on relatively thin sheets after printing on relatively thick sheets, arcuate surface 92*a* of cam follower portion 92 of intermediate operating body 90 comes in contact with sloped cam 84 while moving out of the way of flat surface portion 84*a* which is continuous to sloped cam 84 of operation lever 80, which in turn causes intermediate operating body 90 to move in the direction indicated by arrow X1 in FIG. 5 in conjunction with the rotation of operation lever 80.

When set piece 85 of operation lever 80 comes into contact with pawl 94 of intermediate operating body 90 in conjunction with the rotation of operation lever 80, set piece 85 pushes pawl 94 away from operation lever 80, thereby causing flat spring portion 85*a* to flex in the direction indicated by the arrow b2 in FIG. 12(*a*), and thereby causing intermediate operating body 90 to rotate in the direction indicated by an arrow c in FIG. 12(*a*) against the biasing force of tension spring 64. When intermediate operating body 90 rotates in the direction indicated by arrow c in FIG. 12, set piece 85 returns to its original position through the action of flat spring portion 85*a* thereof, and thereafter rides over pawl 94 so as to oscillate in the direction indicated by arrow b1 while flexing flat spring portion 85*a* in the opposite direction. As a result of this operation, set piece 85 is disengaged from pawl 94, which in turn causes intermediate operating body 90 to rotate counterclockwise by the action of tension spring 64 (in the direction opposite to the direction indicated by the arrow c in FIG. 12). However, intermediate operating body 90 has already moved in the direction indicated by the arrow X1 in FIG. 5. Therefore, outer circumferential surface 93*b* of arm portion 93 is positioned above second cam 27. Hence, the rotation of intermediate operating body 90 in the counterclockwise direction (in the direction opposite to the direction indicated by the arrow c in FIG. 12) after set piece 85 has been disengaged from pawl 94 can be blocked by outer circumferential surface 93*b* of arm portion 93 coming in contact with second cam 27, therefore bringing the printer into the condition shown in FIG. 6 (condition (i)(a)). In other words, set piece 85 is designed to insure that arm portion 93 of intermediate operating body 90 rides over second cam 27 when switching from use of the separating operation utilizing the wall surfaces to use of the separating operation utilizing the separation pawl.

As described above, the printer can individually feed sheets utilizing separation pawl 60 when printing is to be performed on relatively thin sheets. The printer can also individually feed sheets utilizing wall surfaces 16*g*, 16*f* when printing is to be performed on relatively thick sheets. Individual sheets can be reliably fed when utilizing separation pawl 60 even if the number of sheets on the hopper becomes small, such as two or three. Accordingly inadvertent multi-sheet feeding when the sheet separating operation utilizing separation pawl is selected can be prevented.

It will thus be seen that the objects set forth above, and those made apparent from the preceding description, are effectively attained and, since certain changes may be made in the above construction without departing from the spirit and scope of the invention, it is intended that all matter contained in the above description or shown in the accompanying drawings shall be interpreted as illustrative and not in a limiting sense.

It is also understood that the following claims are intended to cover all of the generic and specific features of the invention herein described, and all statements of the scope of the invention which, as a matter of language, might be said to fall therebetween.

What is claimed is:

1. A printer comprising:

a hopper dimensioned to retain a plurality of sheets thereon;

a sheet feed roller for feeding an uppermost sheet of said plurality of sheets maintained on said hopper;

a separation pawl, located at a corner portion of said plurality of sheets held on said hopper, for separating an uppermost sheet from a next uppermost sheet;

a wall surface, located downstream in a sheet feed direction with respect to a plurality of sheets maintained on said hopper, for separating an uppermost sheet from a next sheet;

a selecting mechanism for selecting either a separating operation utilizing said separation pawl or a separating operation utilizing said wall surface;

a recess being formed by said hopper in a surface thereof for accommodating said separation pawl at a position lower than said plurality of sheets held on said hopper when the separating operation utilizing said wall surface is selected by said selecting mechanism; and a regulating means for regulating said separation pawl when the separating operation utilizing said separation pawl is selected by the selecting mechanism so that said separation pawl does not retreat fully into said recess.

2. The printer of claim 1, wherein said sheet feed roller feeds one of a plurality of sheets to be printed upon by being maintained in contact with an uppermost sheet of a plurality of sheets.

3. The printer of claim 1, wherein said selector selects said separating operation utilizing said separation pawl if the sheets to be printed upon have a thickness less than a predetermined thickness.

4. The printer of claim 1, wherein said selector selects said separating operation utilizing said wall surface if the sheets to be printed upon have a thickness greater than a predetermined thickness.

5. The printer of claim 1, wherein a user operates said selecting mechanism.

6. The printer of claim 1, wherein said selecting mechanism is operated automatically.

7. The printer of claim 1, wherein said separation pawl causes an uppermost sheet of a plurality of sheets held on said hopper to flex during a sheet feed operation.

8. The printer of claim 7, wherein said flexed sheet is independently fed during said sheet feed operation.

9. The printer of claim 1, wherein said hopper defines a recess, and further comprising:

a frame;

a support plate fixed to said separation pawl, said support plate supporting the head end of a sheet set on said hopper;

an arm portion fixed to said support plate;

a cylindrical shaft fixed to said arm portion, said cylindrical shaft dimensioned to coaxially fit over a shaft projecting from said frame so as to be rotatable relative to said frame; and a tension spring disposed between said arm portion and said printer adjacent said cylindrical shaft, said tension spring biasing said separation pawl towards said recess;

said separation pawl separating a first of said plurality of sheets from a second of said plurality of sheets during a printing operation.

10. The printer of claim 9, further comprising:

a cylindrical shaft extending from said separation pawl;

an intermediate operating body, a cylindrical base portion fixed to said intermediate operating body being dimensioned to coaxially fit over said cylindrical shaft portion of said separation pawl a fanlike cam follower portion forming an outer edge of said intermediate operating body, an arcuate surface formed on said fanlike cam follower, an arm portion extending from said fanlike cam follower portion, said arm portion having a front end being formed with a substantially arcuate outer circumferential surface, a pawl portion fixed to said cylindrical base portion;

said regulating means including a projecting stopper formed on an outside surface of said printer, said front end of said arm portion being selectively engageable with said projecting stopper;

an operation lever having a sloped cam, said arcuate surface being dimensioned to engage said sloped cam;

wherein said arm portion contacts a stopper fixed to said printer when said plurality of sheets has been reduced to less than a predetermined number to maintain said separation pawl a predetermined distance outside said recess.

11. The printer of claim 10, further comprising:

a plurality of ridgelike projections formed on said cylindrical shaft;

a plurality of recessed grooves formed on an inner surface of said cylindrical base portion, said recessed grooves being selectively engageable with said ridgelike projections;

whereby said intermediate operating body is coaxially fitted over said cylindrical shaft so as to be unrotatable with respect thereto.

12. The printer of claim 11, further comprising a cam surface fixed to said sheet feed roller, said substantially arcuate outer circumferential surface of said arm portion being dimensioned to come into contact with said cam surface to move said hopper away from said sheet feed roller.

13. The printer of claim 10, wherein said operation lever mounted on said frame so as to be rotatable with respect to said frame, said operation lever being selectively rotatable between a first and a second position, said operation lever including a shaft portion;

a cylindrical bearing portion arranged on an inside surface of said frame;

said shaft portion of said operation lever being inserted into said cylindrical bearing portion;

a locking clip fixed to said operation lever, said locking clip selectively coupling said operation lever to said frame;

a click plate fixed to said operation lever, said click plate being formed as a resilient thin plate member, said click plate defining first and second recesses; and a projection on said frame disposed opposite said first and second recesses, said projection being selectively engageable with said recesses;

wherein a first sheet separating operation is selected when said operating body is positioned in said first position and a second sheet separating operation is selected when said operating body is positioned in said second position.

14. The printer of claim 12, further comprising a sloped surface formed on a face of said intermediate operating body;

wherein when sheets of a thickness greater than a predetermined thickness are to be printed upon, said sloped surface contacts said arcuate surface and said arm portion of said operating body is prevented from engaging a stopper fixed to said printer, thereby allowing said separation pawl to be retained in said recess.

* * * * *